US006386794B1

(12) United States Patent
Bitelli

(10) Patent No.: US 6,386,794 B1
(45) Date of Patent: May 14, 2002

(54) PERFECTED VIBRATING DRUM FOR SOIL TAMPING MACHINES

(75) Inventor: Romolo Bitelli, S. Lazzaro (IT)

(73) Assignee: Bitelli SpA, Minerbio (IT)

( * ) Notice: Subject to any disclaimer, the term of this patent is extended or adjusted under 35 U.S.C. 154(b) by 0 days.

(21) Appl. No.: 09/616,049

(22) Filed: Jul. 13, 2000

(30) Foreign Application Priority Data

Jul. 13, 1999 (IT) ..... V199A0150

(51) Int. Cl.[7] ..... E01C 19/38
(52) U.S. Cl. ..... 404/117
(58) Field of Search ..... 404/103, 117, 404/122, 130, 133.05, 133.1, 133.2; 74/61, 87; 366/116, 124, 125, 128

(56) References Cited

U.S. PATENT DOCUMENTS 3,020,683 A * 2/1962 Brandt ..... 451/326
3,616,730 A * 11/1971 Boone et al. ..... 404/117
3,656,419 A * 4/1972 Boone ..... 404/117
3,813,950 A * 6/1974 Ebersole ..... 74/61
4,105,356 A * 8/1978 Loveless ..... 404/117
4,108,009 A * 8/1978 Fuchigami ..... 74/61
4,367,054 A * 1/1983 Salani et al. ..... 404/117
4,619,552 A * 10/1986 Sadahiro ..... 404/117
4,759,659 A * 7/1988 Copie ..... 404/117

* cited by examiner

*Primary Examiner*—David Bagnell
*Assistant Examiner*—Sunil Singh
(74) *Attorney, Agent, or Firm*—Dykema Gossett PLLC

(57) ABSTRACT

A vibrating drum for soil tamping machines, including a cylindrical tubular skirt adapted to be arranged in abutment against soil to be tamped to which is associated a first hydraulic motor which rotates the tubular skirt around a central shaft to move the tubular skirt forward, and a vibration mechanism to make the tubular skirt vibrate. The vibration mechanism includes a second hydraulic motor coupled to an end of the central shaft and a receptacle fastened to the central shaft which delimits a chamber for containing a liquid in which is partly immersed a draught pipe connected to a hydraulic circuit, which includes a pumping mechanism adapted to change an amount of liquid contained in the chamber so as to change the vibration amplitude of the drum.

15 Claims, 3 Drawing Sheets

PERFECTED VIBRATING DRUM FOR SOIL TAMPING MACHINES

BACKGROUND OF THE INVENTION

The invention relates to a vibrating drum for soil tamping machines, whose vibration amplitude can be changed continuously, to the operator's choice.

It is known that soil tamping machines substantially consist of a pair of vibrating drums supported by a frame, on which there stands a cabin for the driver and propulsion means so as to make the machine self-propelled.

In some embodiments, the frame is divided into two portions, each housing one of the vibrating drums, connected in an articulated way by means of a universal joint which co-operates with the steering wheel.

In order to easily tamp the soils, the drums must have a suitable centrifugal force that is defined by their speed of rotation, and they must also vibrate with an amplitude having a suitable value for the type of soil to be tamped.

In fact, a man skilled in the art knows that for soils consisting of earth or of stabilized materials, an optimum tamping is attained by making the drums vibrate with high vibration amplitudes, whereas low vibration amplitudes are adapted to tamp soils consisting of bituminous materials.

The methods for manufacturing the vibrating drums that equip the tamping machines of the known type present on the market have the rotation shaft of the drum provided with a vibration device, which by changing the frequency of rotation of the shaft itself, changes the centrifugal force of the drum.

On the other hand, the vibration amplitude can have two different values attainable by changing the eccentricity of a mass connected to the rotation shaft of the drum.

More precisely, the vibrating shaft is provided with an eccentric mass which, according to the direction of rotation of the shaft, moves into a recessed or protruding position so as to determine two different amplitude values in vibration.

Thus, the vibrating drums of the known type that are manufactured according to the above methods and that are usually applied to the tamping machines present on the market, exhibit the known limit of not having the possibility of changing with continuity the amplitude of their vibration. Accordingly, they do not attain the optimum tamping of all types of soil. The present invention is intended to overcome said known limits.

SUMMARY OF THE INVENTION

In particular, an object of the present invention is that of providing a vibrating drum for soil tamping machines, which should be made to vibrate continuously with amplitudes having variable value.

Said object is attained with the realization of a vibrating drum for soil tamping machines, which includes:

- a cylindrical tubular skirt adapted to be arranged in abutment against the soil to be tamped;
- one or more structural elements radially fastened inside said tubular skirt;
- at least one central shaft in a through arrangement into said one or more structural elements, by which it is supported through rolling means;
- flanging means adapted to make said drum integral with the frame of said tamping machine;
- motorization means comprising at least a first hydraulic motor adapted to place said drum into rotation and vibration means adapted to make it vibrate during rotation, wherein said vibration means comprises at least a second hydraulic motor coupled to an end of said central shaft, and at least one receptacle fastened to said central shaft, which delimits at least one chamber containing a liquid in which there is at least partly immersed at least one draught pipe connected through at least one duct to a hydraulic circuit external to said tubular skirt, said hydraulic circuit comprising pumping means adapted to change the amount of said liquid contained into said at least one chamber so as to change the vibration amplitude of said drum during rotation.

According to a preferred embodiment, inside the tubular skirt there is provided a radially arranged single chamber on a single side with respect to a plane passing through the longitudinal axis of said central shaft to which it is fastened.

The hydraulic circuit external to the tubular skirt is provided with a reversible pump, which through a feeding pipe makes the liquid circulate from the chamber inside the drum to an outer reservoir, and vice versa.

According to an embodiment variant, the reversible pump can be replaced by an irreversible pump associated to a dispenser.

According to a further alternative embodiment, inside the tubular skirt there are provided two chambers, arranged radially and at opposed sides with respect to the plane passing through the longitudinal axis of the central shaft to which they are fastened.

In all of the illustrated embodiments, the vibration means and the motorisation means comprise hydraulic motors.

There are also provided level indicators electrically connected to an electronic control gearcase, which automatically changes the liquid level inside the reservoirs according to the tamping degree of the soil.

Advantageously, the vibrating drum of the invention allows tamping different soils, with a better quality than that attainable using tamping machines provided with vibrating drums of the known type.

DESCRIPTION OF THE SEVERAL VIEWS OF THE DRAWINGS

The vibrating drum of the invention is described with reference to the attached drawings, wherein it is represented purely as an indication and not in a limiting way, and wherein.

DESCRIPTION OF THE INVENTION

Figure 1:
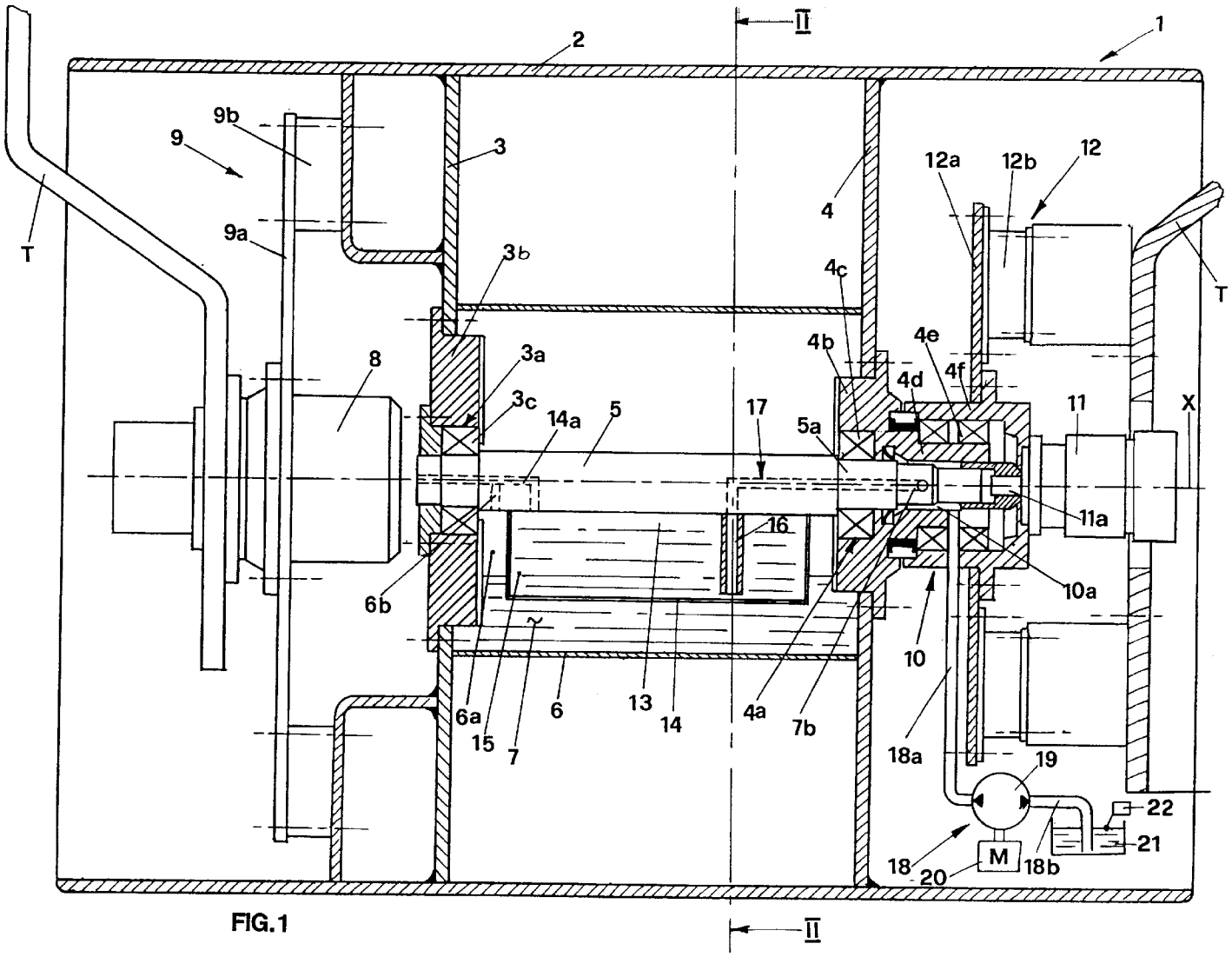
FIG. 1 shows a first embodiment of the drum of the invention in longitudinal section.
Figure 2:
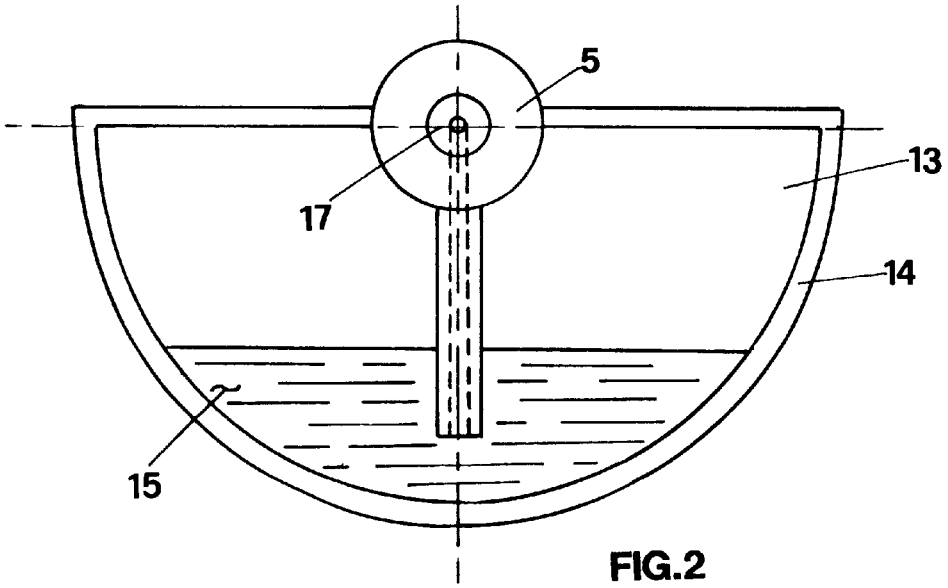
FIG. 2 shows a detail of the transverse section of the drum of FIG. 1 carried out according to the section plane II°.

The vibrating drum of the invention which can be seen in FIG. 1, where it globally indicated with reference numeral 1, is applied to a tamping machine of which a portion of the frame indicated with T is visible in FIG. 1.

Drum 1 comprises a cylindrical tubular skirt 2, which is arranged in abutment against soil S to be tamped, inside which there is radially fastened a pair of structural support elements which, as it can be seen, consist of a first disk 3 and of a second disk 4 axially spaced, coaxial to one another and to the tubular skirt 2.

Each of said disk 3, 4 exhibits a through axial hole, respectively 3*a*, 4*a*, wherein there is housed a flange 3*b*, 4*b* which supports a corresponding bearing 3*c*, 4*c* for the support of a central shaft 5, which defines a substantially horizontal longitudinal axis X of rotation of the vibrating drum 1. Between disks 3, 4 there is provided a tubular element 6 arranged coaxial to the same disks, to the tubular skirt 2 and to the central shaft 5, which defines an inner reservoir 6*a* wherein there is contained the lubricating oil 7 of bearings 3*c*, 4*c*.

A first vent pipe 6*b* obtained by partially drilling shaft 5 in axial and radial direction incident with one another, keeps reservoir 6*a* at atmospheric pressure.

Sideways to the first disk 3 there is arranged a first hydraulic motor 8 supported by frame T, whose rotating members are connected to the first disk 3 by means of first flanging means 9 comprising a first flange 9*a* and first vibration-damping means 9*b*.

End 5*a* of the central shaft 5 is supported by flange 4*b*, which is provided with an axially protruding tubular body 4*d* on which there are externally mounted rolling bearings 4*e*.

Externally to bearings 4*e* there is coupled a cylindrical body 4*f*, which is fastened to frame T of the machine by means of second flanging means 12, which, as shown in FIG. 1, comprises a second flange 12*a* and vibration-damping means 12*b* with which it is connected to frame T of the machine. Moreover, to the cylindrical body 4*f* there is axially flanged a second hydraulic motor 11, which is in a through arrangement into an aperture Ta made into frame T of the machine, and which exhibits shaft 11*a* coupled to end 5*a* of the central shaft 5.

The first hydraulic motor 8 places drum 1 in rotation, which makes the machine move forward, while vibration means associated to drum 1 impart to the latter also a vibration which favours the tamping of the soil.

According to the invention, said vibration means comprises at least a second hydraulic motor 11 coupled to an end 5*a* of said central shaft 5, and at least one receptacle 14 fastened to said central shaft 5, which delimits at least one chamber 13 containing a liquid 15 wherein there is at least partly immersed at least one draught pipe 16 connected through at least one duct 17 to a hydraulic circuit 18 external to said tubular skirt 2, said hydraulic circuit 18 comprising pumping means 19 adapted to change the amount of said liquid 15 contained into said at least one chamber 13 so as to change the amplitude of vibration of said drum 1 during vibration.

Preferably, duct 17 is associated to the central shaft 5 and is realised by making into the same shaft 6 a hole, which partly passes through it in axial and radial direction, thus placing the draught pipe 16 of chamber 13 in communication with the outer environment.

The preferred embodiment illustrated in FIG. 1 is provided with a single chamber 13 delimited by a single closed receptacle 14, which is arranged on a single side with respect to a plane passing through the longitudinal axis X of the central shaft 5, and it is maintained at ambient pressure by a second vent pipe 14*a* which communicates with said first vent pipe 6*b*.

As the tubular body 4*d* belongs to flange 4*b* fastened to disk 4 of drum 2, it rotates around axis X when drum 2 moves forward on soil S moved by the motorization means consisting of the first hydraulic motor 8, whereas the cylindrical body 4*f* remains stationary with respect to the tubular body 4*d*, being it fastened to frame T of the machine.

The interposition of rolling bearings 4*e* allows the relative motion of rotation between tubular body 4*d* and cylindrical body 4*f*.

The cylindrical body 4*f* and the tubular body 4*d* thus define a rotating dispenser, globally indicated with reference numeral 10, wherein there is defined a distribution chamber 10*a* which communicates with duct 17 associated to the central shaft 5 and with a first pipe 18*a* of the outer hydraulic circuit, globally indicated with reference numeral 18.

In particular, the hydraulic circuit 18 comprises a pump 19 of the reversible type, which is placed into rotation by an electrical motor 20, which exhibits the delivery connected to the first pipe 18*a* and the suction connected to a second pipe 18*b*, which communicates with a reservoir 21 containing oil or other liquid provided with level indicator 22.

Operatively, the first hydraulic motor 8 is fed with oil under pressure coming from the propulsion unit of the machine, and it places drum 1 into rotation. At the same time, the second hydraulic motor 11, also fed with oil under pressure from the propulsion unit of the machine, places the central shaft 5 into rotation, making the same drum vibrate for the presence of the eccentric load consisting of the liquid contained into chamber 13.

Thus, the second hydraulic motor 11 and receptacle 14 delimiting chamber 13 are the vibration means that make the drum vibrate during rotation.

The rotation and the concurrent vibration of rotating drum 1 are thus obtained, which allow carrying out the tamping of soil S during the forward movement of the machine.

The actuation of pump 19 in delivery or in suction with respect to chamber 13, allows changing the liquid weight present into it 15, thus changing with continuity the vibration amplitude of the vibrating drum, adapting it to the type of soil to be tamped.

For this purpose, an electric/electronic control device, not shown in the figures, is provided on-board on the machine which is electrically connected to vibrator 11 and to the level indicator 22 of the liquid contained into the outer reservoir 21, which maintains into chamber 13 the amount of liquid needed for the amplitude of the vibration of the central shaft 5 to be optimum according to the type of soil S to be tamped.

Figure 4:
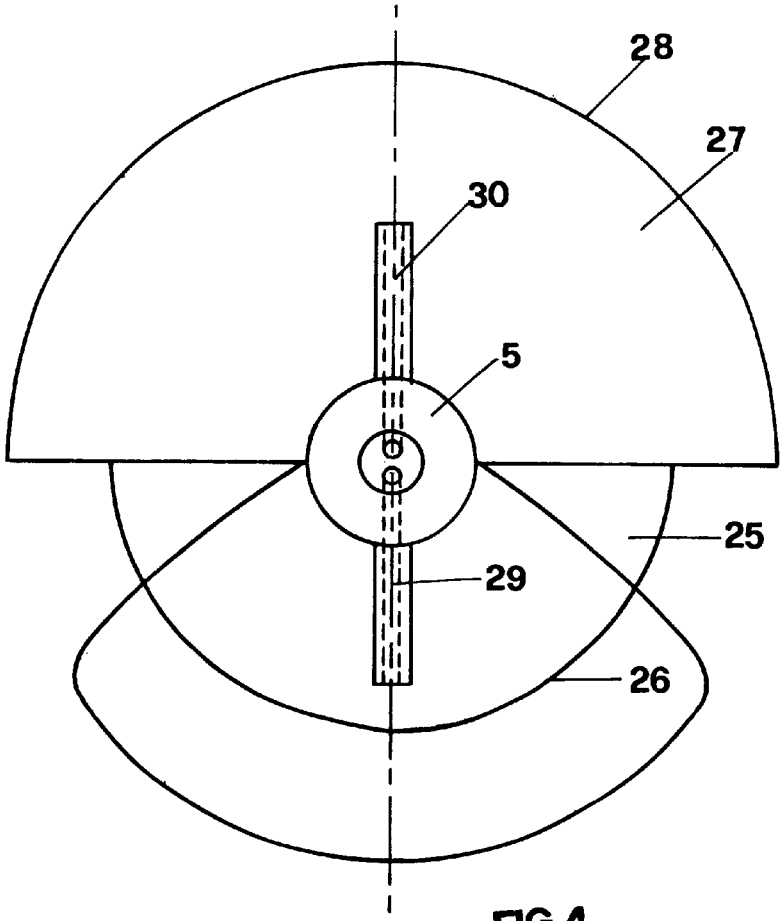
FIG. 4 shows a detail of the transverse section of the drum of FIG. 3 carried out according to the section plane IV.

An alternative embodiment of the vibrating drum of the invention is represented in FIG. 4, and it differs from that previously described for the presence, inside the tubular skirt 2, of a first chamber 25 delimited by a first closed receptacle 26 and a second chamber 27 delimited by a second closed receptacle 28.

Figure 3:
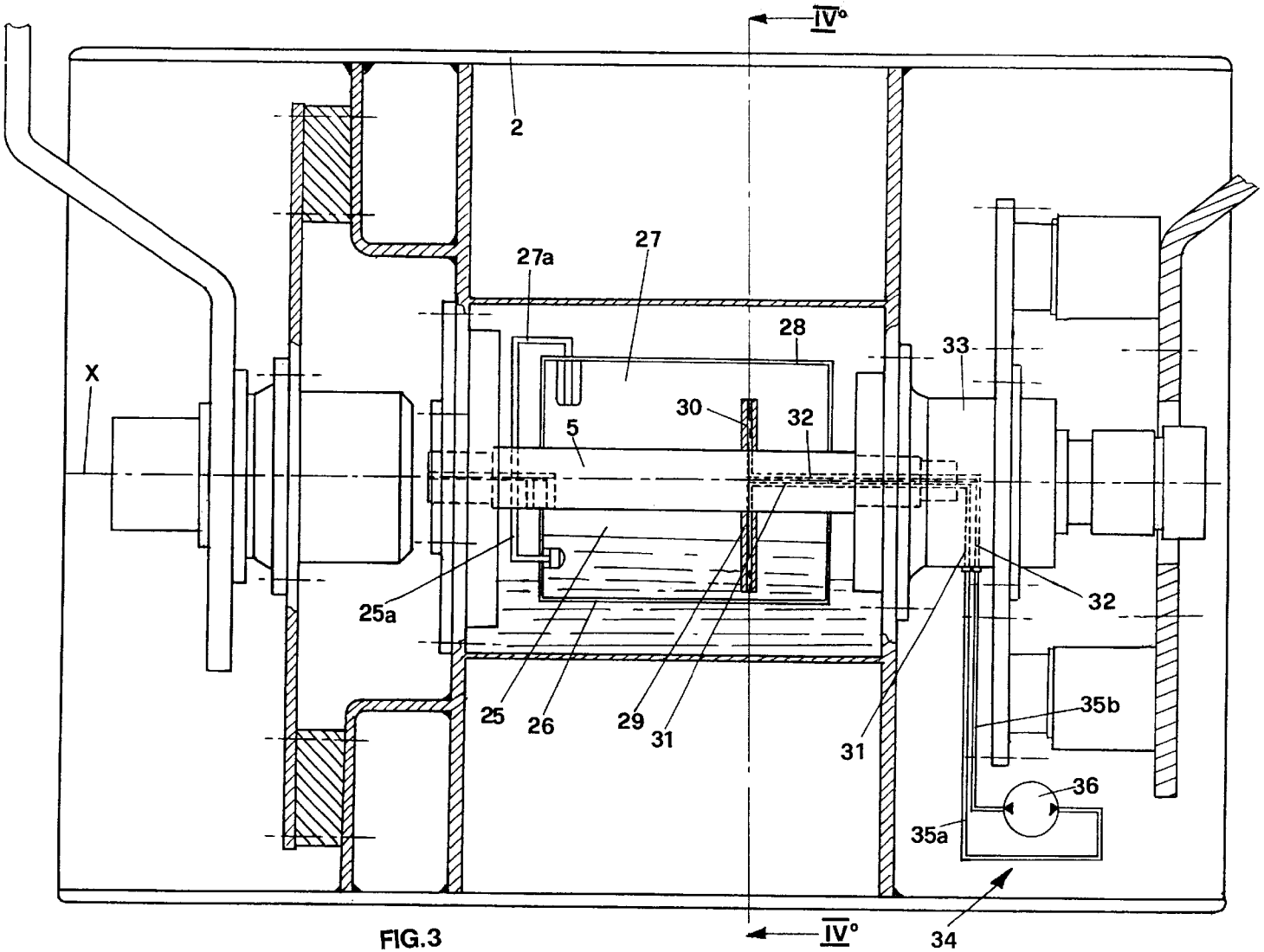
FIG. 3 shows a second embodiment of the drum of the invention in a longitudinal section view.

Chambers 25 and 27, as it can be seen in the section of FIG. 4, are independent of one another, and receptacles 26 and 28, which delimit them, are arranged at opposed sides with respect to a plane passing through the longitudinal axis X to the central shaft 5 to which they are connected. Vent pipes 25*a* and 27*a*, shown in FIG. 3, are in communication with the ambient pressure and maintain both chambers at the atmospheric pressure.

In said alternative embodiment, each chamber 25, 27 respectively is provided with a first draught pipe 29 and with a second draught pipe 30, which are connected to an outer hydraulic circuit 34 respectively by means of ducts 31, 32 formed into the central shaft 5, and a rotating dispenser 33 arranged at the end of the central shaft 5 itself.

In particular, the hydraulic circuit 34 comprises a first pipe 35*a* hydraulically connected to the first chamber 25 through the first duct 31 and a second pipe 35*b* hydraulically connected to the second chamber 27 through the second duct 32, which are both hydraulically connected to the pumping means consisting of a pump 36 associated to a dispenser connected to ducts 31 and 32.

Operatively, pump 36 transfers the oil between chambers 25 and 26 so as to make the outer reservoir—whose function is carried out by the same chambers—unnecessary.

By suitably adjusting the amounts of oil contained in each chamber, it is possible to attain the desired vibration amplitude of the drum during rotation. On the basis of the above disclosure, it can be understood that the vibrating drum of the invention achieves the objects set forth.

It is evident that modifications can be made to the embodiments of the drum, for example to the shape of the reservoirs and of the chambers, or to the flanging devices, to the tubular skirt and to the machine frame.

Optionally, it is also possible to change the outer oil circulation circuit into the chambers, which—for example in the single-chamber embodiment of the drum—can be provided with a single-directional pump having an associated dispenser, in place of a reversible pump.

Therefore, although the invention has been described with reference to the figures represented in the attached drawings, optional practical modifications or alternatives falling within the inventive concept as set forth by the attached claims are all to be regarded as protected under the present patent.

What is claimed is:

1. A vibrating drum for a soil tamping machine comprising:

a tubular skirt adapted to be arranged in abutment against soil to be tamped;

one or more structural elements radially fastened inside said tubular skirt;

a central shaft in a through arrangement into said one or more structural elements, supported by rolling means;

flanging means adapted to make said tubular skirt integral with a frame of said tamping machine;

motorization means comprising at least a first hydraulic motor adapted to place said tubular skirt into rotation and vibration means adapted to make said tubular skirt vibrate, wherein said vibration means comprises at least a second hydraulic motor coupled to an end of said central shaft and a receptacle fastened to said central shaft which delimits a chamber for containing a liquid in which may be at least partly immersed at least one draught pipe connected through at least one duct to a hydraulic circuit, said hydraulic circuit comprising pumping means adapted to change an amount of liquid contained in said chamber so as to change a weight of liquid therein and thereby change the vibration amplitude of said drum.

2. The vibrating drum according to claim 1, wherein said at least one duct is associated with said central shaft, and has an end connected to said hydraulic circuit.

3. The vibrating drum according to claim 1, wherein said chamber is arranged only on a side with respect to a plane passing through the longitudinal axis of said central shaft.

4. The vibrating drum according to claim 3, wherein said hydraulic circuit comprises a first pipe hydraulically connected to said chamber, and a second pipe hydraulically connected to a reservoir, said first pipe and said second pipe being connected to said pumping means.

5. The vibrating drum according to claim 4, wherein said pumping means comprises a reversible pump.

6. The vibrating drum according to claim 4, wherein said pumping means comprises a pump associated with a dispenser.

7. The vibrating drum according to claim 1, further comprising a second chamber delimited by a second receptacle, said chamber and said second chamber being independent and said receptacle and said second receptacle being arranged at opposed sides with respect to a plane passing through the longitudinal axis of said central shaft.

8. The vibrating drum according to claim 7, wherein said hydraulic circuit comprises a first pipe hydraulically connected to said chamber and a second pipe hydraulically connected to said second chamber, said first pipe and said second pipe being connected to said pumping means.

9. The vibrating drum according to claim 1, wherein said one or more structural elements each comprise at least a pair of axially spaced, coaxial disks coaxial to said tubular skirt.

10. The vibrating drum according to claim 9, wherein said at least a pair of disks are connected by a tubular element coaxial, and adapted to delimit, inside said tubular skirt, a reservoir for containing lubricating oil.

11. The vibrating drum according to claim 10, wherein said reservoir contains said chamber.

12. The vibrating drum according to claim 1, wherein said at least one duct comprises axial and radial bores formed into said central shaft.

13. The vibrating drum according to claim 12, wherein one end of said at least one duct is connected to a rotating dispenser arranged at an end of said central shaft and adapted to hydraulically connect said at least one duct to said hydraulic circuit.

14. The vibrating drum according to claim 13, wherein said rotating dispenser comprises a tubular body connected to a flange fastened to one of said structural elements, externally and coaxially to which there is arranged a cylindrical body adapted to be fastened to said frame, between which there are interposed one or more rolling bearings.

15. The vibrating drum according to claim 13, wherein in said rotating dispenser there is defined a distribution chamber which communicates with said at least one duct associated with said central shaft and with said hydraulic circuit.

* * * * *